US011041350B2

(12) United States Patent
Palmer

(10) Patent No.: US 11,041,350 B2
(45) Date of Patent: Jun. 22, 2021

(54) MUD MOTOR STALL PROTECTOR

(71) Applicant: Larry Palmer, Spring, TX (US)

(72) Inventor: Larry Palmer, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/138,027

(22) Filed: Sep. 21, 2018

(65) Prior Publication Data

US 2020/0095836 A1 Mar. 26, 2020

(51) Int. Cl.

| | |
|---|---|
| ***E21B 21/10*** | (2006.01) |
| ***E21B 4/02*** | (2006.01) |
| ***E21B 34/10*** | (2006.01) |
| ***E21B 34/14*** | (2006.01) |
| ***E21B 21/08*** | (2006.01) |

(52) U.S. Cl.

CPC ..... *E21B 21/103* (2013.01); *E21B 4/02* (2013.01); *E21B 21/08* (2013.01); *E21B 34/10* (2013.01); *E21B 34/14* (2013.01); *E21B 2200/06* (2020.05)

(58) Field of Classification Search

CPC ..... E21B 34/14; E21B 21/103; E21B 4/02; E21B 4/08; E21B 34/10

See application file for complete search history.

(56) References Cited

U.S. PATENT DOCUMENTS

| | | | | |
|---|---|---|---|---|
| 6,263,969 | B1 | 7/2001 | Stoesz et al. | |
| 7,757,781 | B2 | 7/2010 | Hay et al. | |
| 2004/0129423 | A1* | 7/2004 | Eddison | E21B 21/103 166/321 |
| 2018/0163509 | A1* | 6/2018 | Churchill | E21B 21/103 |

* cited by examiner

*Primary Examiner* — Kristyn A Hall
*Assistant Examiner* — Dany E Akakpo
(74) *Attorney, Agent, or Firm* — Cantor Colburn LLP

(57) ABSTRACT

A mud motor stall protector including a housing, a piston translationally disposed in the housing, the piston defining a flow passage therein, and a pin positioned relative to the housing to occupy a portion of the flow passage of the piston or leave the flow passage of the piston open depending upon position of the piston relative to the pin.

16 Claims, 4 Drawing Sheets

MUD MOTOR STALL PROTECTOR

BACKGROUND

In the resource recovery industry, mud motors are common devices used to generate torque for uses including drilling among other things. Mud motors utilize the energy of a flowing fluid therethrough to generate rotational torque that is applied in one example to a drill bit. Occasionally the torque created in the mud motor is insufficient to drive the connected tool (e.g. drill bit) through whatever is the target surface. This results in a stall of the mud motor. Fluid flowing through the mud motor without the mud motor rotating changes from a positive operational action to a detrimental one. Specifically, the same flowing fluid that provided the energy for the generation of torque in the rotating mud motor will cause damage to the motor in the form of flow cutting and erosion of sealing surfaces within the mud motor when the motor is not able to rotate due to insufficient torque to overcome the surface against which the connected tool is turning. Such flow cutting and erosion results in delays and increased costs and hence is undesirable to the operator. The art would well receive solutions that avoid such damage.

SUMMARY

A mud motor stall protector including a housing, a piston translationally disposed in the housing, the piston defining a flow passage therein, and a pin positioned relative to the housing to occupy a portion of the flow passage of the piston or leave the flow passage of the piston open depending upon position of the piston relative to the pin.

A mud motor protector including a housing, and a piston disposed within the housing and defining a fluid flow channel therein, the piston being first responsive to a pressure differential across a set of piston seals resulting in piston movement that causes a reduction in flow area in the fluid flow channel of the piston and then responsive primarily to the restriction of the flow area of the fluid flow channel through the piston.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
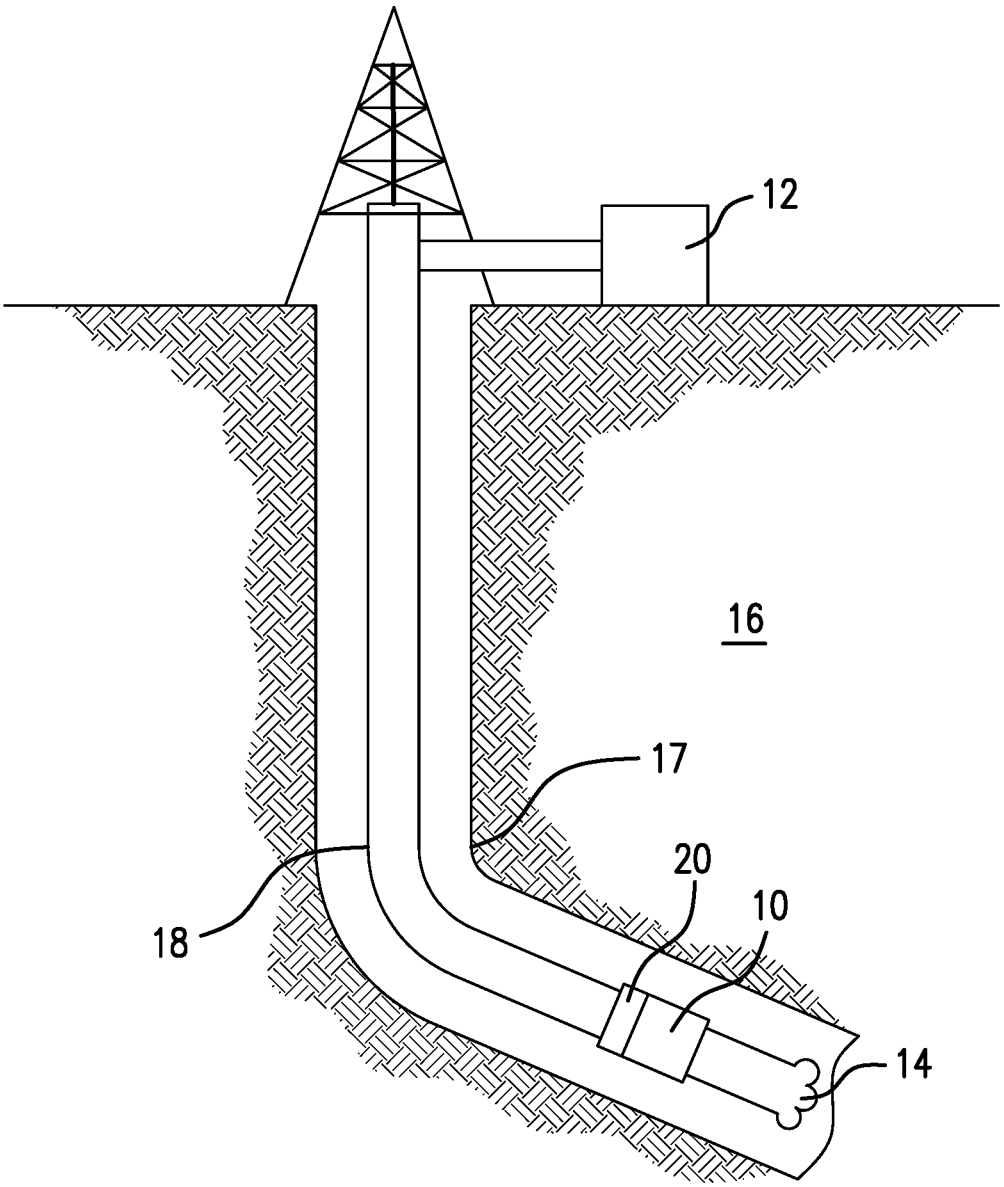
FIG. 1 is a view of a borehole system in a subsurface formation and having a mud motor stall protector therein.

As will be appreciated by one of ordinary skill in the art, and referring to FIG. 1, when a mud motor 10 stalls, a rotor of the mud motor cannot turn and hence adopts a fixed position relative to a mud motor stator. In such a condition, fluid flowing through the mud motor 10 is no longer distributed over nearly all of the surface area thereof but rather is restricted to a much smaller pathway through the mud motor 10. Fluid flow through the mud motor is occasioned by fluid emanating from a pump/source 12, such as a surface reservoir, at for example, 4 barrels per minute. Such flow rate would not change in a mud motor configuration of the prior art when that motor is in a stalled condition but rather the fluid simply would be pushed through the much smaller pathway. Accordingly, it can be easily seen and has been recognized by the art that flow cutting and erosion are a problem. Addressing this problem by just relieving the fluid pressure with components such as a blow off valve (known in the art) does not resolve the problem. As long as enough fluid still flows in the mud motor, there is a small amount of torque produced on a tool similar to 14 (e.g. drill bit) in FIG. 1 attached to the mud motor similar to 10 in FIG. 1 (FIG. 1 itself is not intended to be a prior art depiction since it illustrates an embodiment of the disclosure hereof as a part of a well system but since appearance Is similar the Figure can also be illustrative of the present discussion). The torque keeps the tool 14 engaged with the surface such as formation 16) through which the tool 14 was supposed to be drilling to create a borehole 17. Reapplication of fluid pressure after the blow off valve vents does nothing to alleviate the engagement and hence the mud motor 10 remains stalled. Rather, according to the teachings hereof, it is necessary that torque be removed from the tool 14 so that the tool 14 will be disengaged from the formation and the drilling operation be restarted upon the reapplication of flowing fluid to the unstalled mud motor. Disengaging the tool 14 from the formation 16 allows the operator to pull up on a string 18 upon which the mud motor 10 and drill bit 14 are operating. Pulling up will release any connection and allow a restart of the motor 10 free of the stall. A mud motor stall protector as taught herein accomplishes this result.

Figure 2:
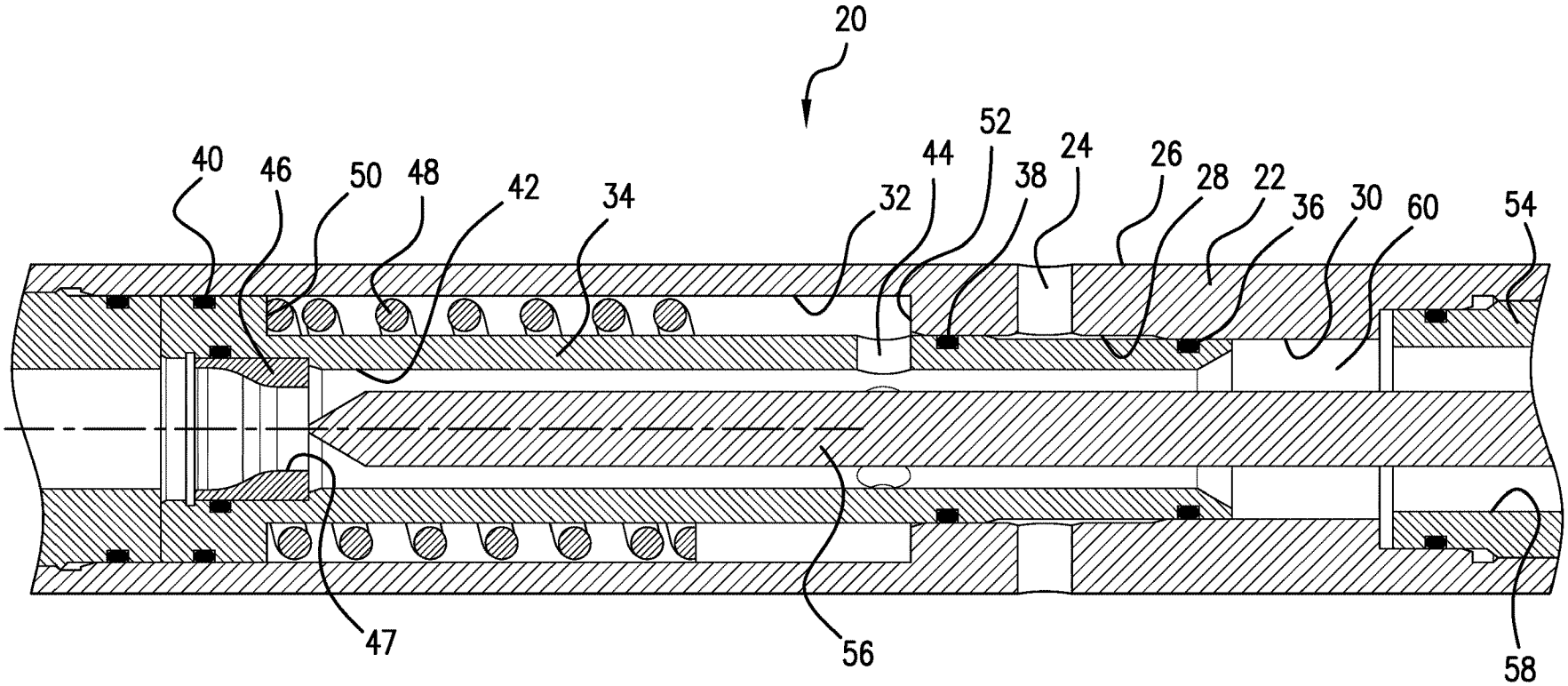
FIG. 2 is a cross section view of a mud motor stall protector as disclosed herein in a closed position.

Referring to FIG. 2, a mud motor stall protector 20 is illustrated. It is to be understood that the mud motor 10 (FIG. 1) is fluidly connected to the protector 20 at the right or downhole side of FIG. 2. It is further to be understood that the string 18 (FIG. 1) is connected to the left or uphole side of FIG. 2. The string 18 is connected to the source 12 of fluid being pumped to run the mud motor 10 as illustrated in FIG. 1.

Figure 3:
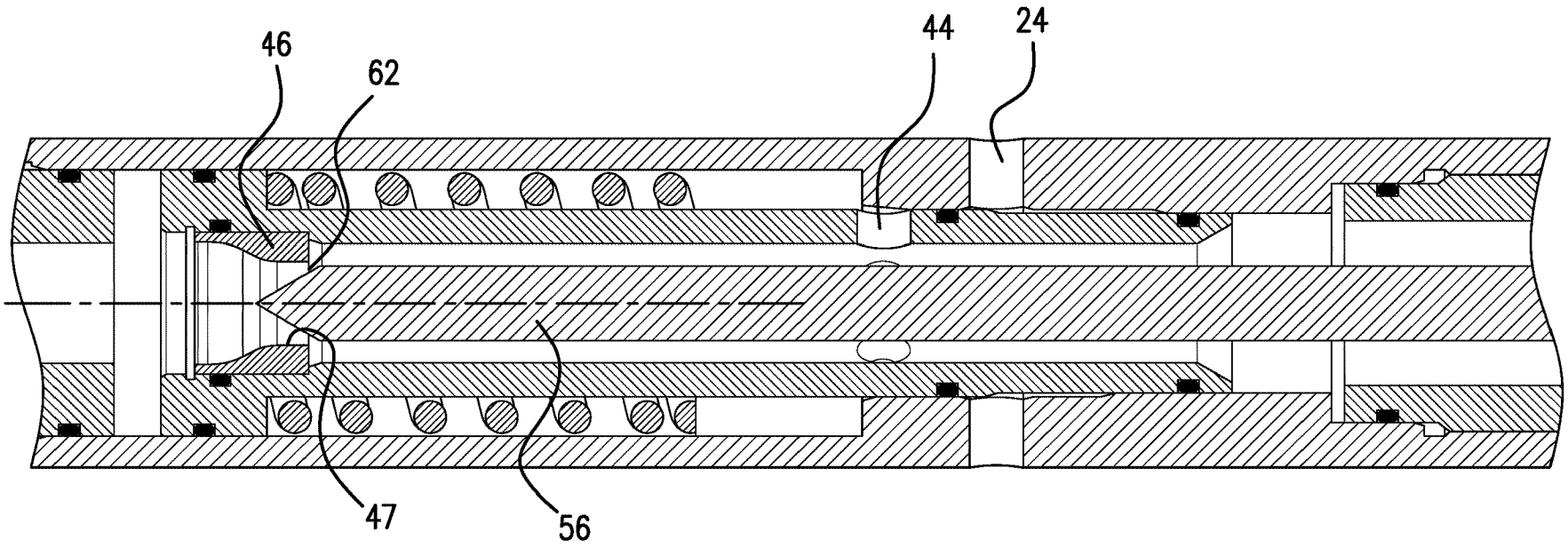
FIG. 3 is the protector of FIG. 2 in a seal break position.
Figure 4:
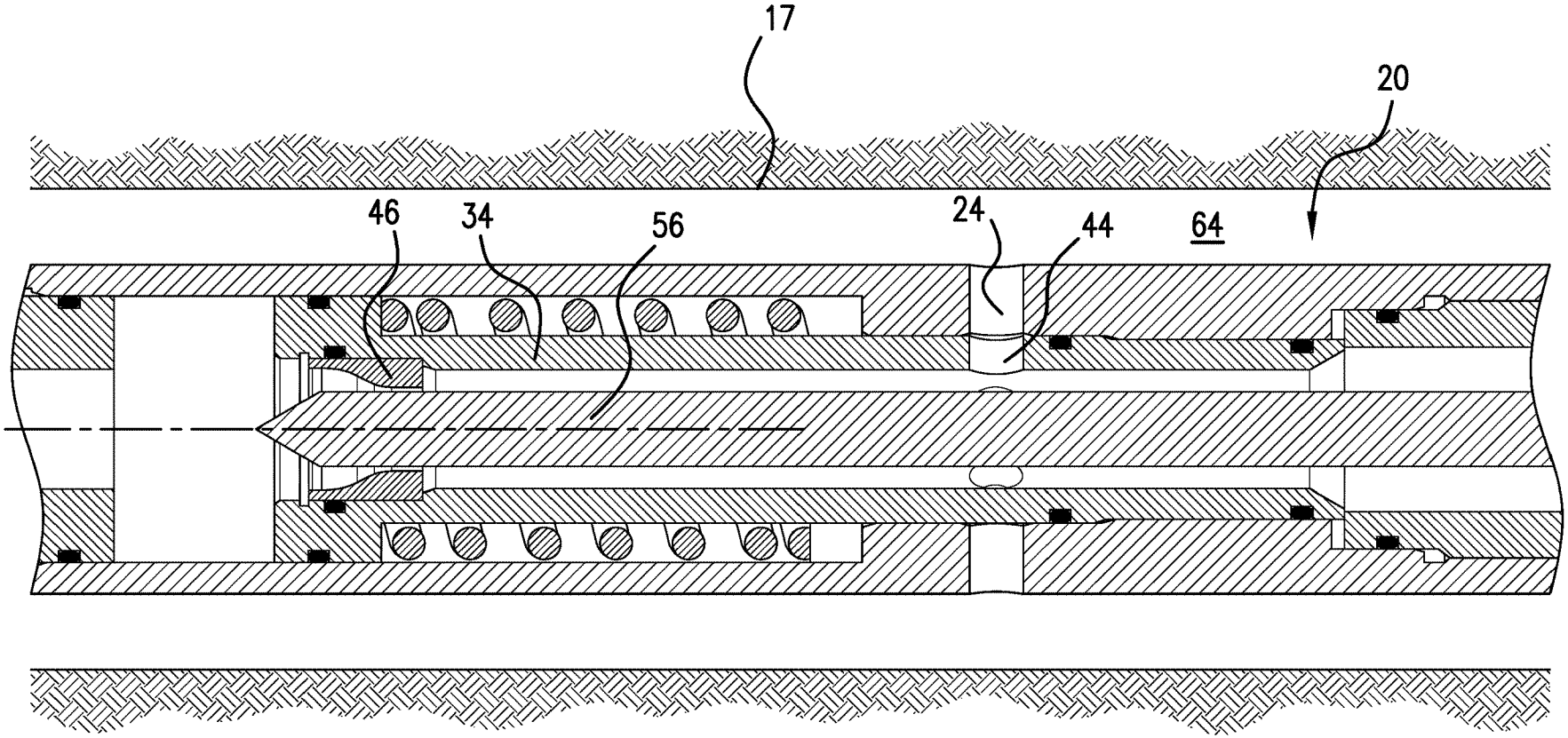
FIG. 4 is the protector in an open position.

Protector 20 comprises a housing 22 that includes a housing port 24 (two are shown, more or fewer are contemplated) extending between an outer surface 26 of the housing and an inside dimension surface 28. In an embodiment, the housing also defines two additional inside surfaces 30 and 32. Inside surface 30 is of a diameter smaller than the diameter of the inside surface 28. A piston 34 is shaped to communicate with the surfaces 30 and 28 through seals 36 and 38. The piston is also shaped to communicate with surface 32 through seal 40. The communications and their effects are discussed hereunder. The piston 34 defines a flow passage 42 and an opening 44 (three visible but more or fewer contemplated) that is alignable or misalignable with the port 24 depending upon the position of the piston 34. The piston 34 further includes a nozzle 46 that may be formed within the piston or may be a separate component that is disposed in sealed relationship with the piston 34. The nozzle defines a fluid conduit 47 that supplies fluid to flow passage 42 during use. In an embodiment, a biasing member 48 such as a spring is disposed between a piston shoulder 50 and a housing shoulder 52. The spring 48 is a compression spring that will urge the piston back to a closed position (shown in FIG. 2) when pressure activation forces are insufficient to keep the piston in the open position (FIGS. 3 and 4). Connected to the housing is a protector sub 54. The sub 54 in an embodiment supports a pin 56 that extends into the piston flow passage 42 and depending upon piston position, extends into the nozzle 46, reducing a flow area therethrough. The protector sub 54 also includes a supply channel 58 (two shown but more or fewer contemplated) that supplies fluid to the mud motor 10 attached to the downhole end of the protector 20 as noted above.

Having described all of the parts of the protector 20 above, its operation is here addressed. Due to the surfaces 30 and 28 being of differing diameter, a differential piston area is created between the seals 36 and 38. Accordingly, when pressure is applied to the seals 36 and 38 through opening 44 and from a volume 60, the differential piston areas will cause the piston 34 to move. The pressure increase that piston 34 is designed to respond to is related to a motor stall. Specifically, when the motor 10 stalls and the flow therethrough becomes labored, the pressure of the fluid being supplied thereto through protector sub 54 increases (since it is being pumped from a remote location and now suddenly cannot flow as easily through the mud motor 10). That pressure exists through the fluid in volume 60 and through openings 44 and in the piston flow passage 42 for example. This pressure thus acts on the seals 36 and 38 as described. The piston 34 will then move as described, that movement being toward the right side of FIG. 2. This latter condition is illustrated in FIG. 3, to which reference is encouraged.

Referring to FIG. 3, the piston 34 has moved to being the opening 44 closer to alignment with port 24 but the more significant change is that the piston 34 has moved to a position where the pin 56 occupies at least a portion of the fluid conduit 47 of the nozzle 46. One of ordinary skill in the art will appreciate that a flow area otherwise defined within fluid conduit 47 when open will be significantly restricted when the pin 56 is at least partially occupying the fluid conduit 47. As this is not a seal, fluid will still flow past the restriction 62 but the pressure of the fluid (flowing from left of Figure) will be substantially higher upstream (to the left) of the restriction 62 than it is downstream (to the right) of the restriction 62. The piston 34 while initially being responsive to the differential pressure at seals 36 and 38, will at the point the restriction 62 is made be instead responsive to differential pressure across the restriction. This is not to say that the pressure differential across seals 36 and 38 disappears, but rather only that the pressure differential across restriction 62 represents a greater impetus on the piston 34 and hence eclipses the activity of the pressure differential across seals 36 and 38. In view hereof, the piston 34 will move even more downstream (to the right of Figure) thereby aligning the opening 44 with the port 24, and causing the pin 56 to occupy even more of the conduit 47 as illustrated in FIG. 4. Pressure in the volume 60 is vented to annulus 64 in this position allowing the tool 14 to disengage with the formation 16 so that the string 18 may be lifted and the motor 10 restarted. Because the restriction 62 maintains the piston in the opening and port aligned condition regardless of pressure caused by the stall, the piston 34 does not cycle like those in the prior art in an endless effort to free the tool 14 that will never happen. Rather, the fluid pressure is nearly all removed from the tool ensuring disengagement from the work surface enabling lift up and restart. Upon disengagement, the pumps are shut down which allows the piston 34 to be reset by spring 48 so that renewed fluid flow will restart the motor without the encumbrance of the stall.

The protector 20 disclosed herein ensures reduced erosional damage to a mud motor 10 because the protector automatically continues to keep the motor free of fluid flow until the pumps 12 are shut down. Hence the delay of which those of skill in the art are painfully aware between the onset of a stall and the recognition of that fact resulting in the shutting down of pumps 12 has no additional deleterious effect on the mud motor since the protector 20 maintains the motor 10 in the safe condition until the pumps are actually shut down due to the fact that the protector piston 34 cannot reset until the pumps 12 are shut down and pressure and flow upstream of the protector 20 have ceased.

Set forth below are some embodiments of the foregoing disclosure:

Embodiment 1: A mud motor stall protector including a housing, a piston translationally disposed in the housing, the piston defining a flow passage therein, and a pin positioned relative to the housing to occupy a portion of the flow passage of the piston or leave the flow passage of the piston open depending upon position of the piston relative to the pin.

Embodiment 2: The protector as in any prior embodiment wherein the housing further includes a port extending from an inside surface of the housing to an outside surface of the housing.

Embodiment 3: The protector as in any prior embodiment wherein the piston includes an opening alignable or misalignable with the housing port depending upon position of the piston within the housing.

Embodiment 4: The protector as in any prior embodiment wherein the housing further defines at least two inside dimension areas.

Embodiment 5: The protector as in any prior embodiment wherein the at least two areas are on opposing sides of a port extending from an inside surface of the housing to an outside surface of the housing.

Embodiment 6: The protector as in any prior embodiment wherein the at least two areas create, with the piston, a differential piston area that causes the piston to translate during use of the protector based upon exposure to a threshold pressure.

Embodiment 7: The protector as in any prior embodiment wherein the threshold pressure is associated with a stall of a mud motor operably attached to the protector.

Embodiment 8: The protector as in any prior embodiment wherein the housing defines three inside dimension areas.

Embodiment 9: The protector as in any prior embodiment wherein the piston further includes a nozzle.

Embodiment 10: The protector as in any prior embodiment wherein the pin and the piston, when the pin occupies a portion of a fluid conduit of a nozzle of the piston, create a pressure drop in flowing fluid.

Embodiment 11: The protector as in any prior embodiment wherein the pressure drop urges the piston to a position where a piston opening is aligned with a housing port.

Embodiment 12: The protector as in any prior embodiment wherein pressure drop urges the piston against a reset spring.

Embodiment 13: The protector as in any prior embodiment further comprising a protector sub attached to the housing and supporting the pin.

Embodiment 14: The protector as in any prior embodiment wherein the protector sub includes supply channels that supply fluid to a mud motor.

Embodiment 15: A mud motor protector including a housing, and a piston disposed within the housing and defining a fluid flow channel therein, the piston being first responsive to a pressure differential across a set of piston seals resulting in piston movement that causes a reduction in flow area in the fluid flow channel of the piston and then responsive primarily to the restriction of the flow area of the fluid flow channel through the piston.

Embodiment 16: The protector as in any prior embodiment wherein a pin fixed relative to the housing, when occupying a portion of the fluid flow channel of the piston causes the reduction in flow area.

Embodiment 17: A mud motor system including a mud motor, and a mud motor protector as in any prior embodiment fluidly connected to the mud motor.

Embodiment 18: A mud motor system including a mud motor, and a mud motor protector as in any prior embodiment fluidly connected to the mud motor.

Embodiment 19: A well system including a borehole in a subsurface formation, a string disposed in the borehole, a mud motor protector as in any prior embodiment connected to the string, and a mud motor fluidly connected to the mud motor protector.

Embodiment 20: A well system including a borehole in a subsurface formation, a string disposed in the borehole, a mud motor protector as in any prior embodiment connected to the string; and a mud motor fluidly connected to the mud motor protector.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A mud motor stall protector comprising:

a housing defining at least two inside dimension areas having different dimensions from each other, the housing further defining a port;

a piston translationally disposed in the housing, the piston defining a flow passage therein and having one end in operable contact with one of the at least two inside dimension areas and another end in operable contact with another of the at least two inside dimension areas, the piston defining a nozzle, the piston also defining a piston opening therein, downstream of the nozzle; and a pin fixedly positioned relative to the housing to occupy the nozzle of the piston to create a relatively greater restriction on fluid flow through the nozzle and align the opening with the port to vent fluid pressure downstream of the nozzle and maintain pressure upstream of the nozzle or leave the nozzle of the piston open to create a relatively lesser restriction on fluid flow through the nozzle depending upon a movable position of the piston relative to the fixed position pin.

2. The protector as claimed in claim 1 wherein the housing port extends from an inside surface of the housing to an outside surface of the housing.

3. The protector as claimed in claim 2 wherein the piston opening is alignable or misalignable with the housing port depending upon position of the piston within the housing.

4. The protector as claimed in claim 1 wherein the at least two areas are on opposing sides of the housing port.

5. The protector as claimed in claim 1 wherein the at least two areas create, with the piston, a differential piston area that causes the piston to translate during use of the protector based upon exposure to a threshold pressure.

6. The protector as claimed in claim 5 wherein the threshold pressure is associated with a stall of a mud motor operably attached to the protector.

7. The protector as claimed in claim 1 wherein the housing defines three inside dimension areas including the at least two inside dimension areas.

8. The protector as claimed in claim 1 wherein when the pin occupies a portion of a fluid conduit of the nozzle of the piston, the pin creates a pressure drop in flowing fluid through the nozzle of the piston.

9. The protector as claimed in claim 8 wherein the pressure drop urges the piston to a position where the piston opening is aligned with the housing port.

10. The protector as claimed in claim 9 wherein the pressure drop urges the piston against a reset spring.

11. The protector as claimed in claim 1 further comprising a protector sub attached to the housing and supporting the pin.

12. The protector as claimed in claim 11 wherein the protector sub includes supply channels that supply fluid to a mud motor.

13. A mud motor system comprising:

a mud motor; and the mud motor protector as claimed in claim 11 fluidly connected to the mud motor.

14. A mud motor system comprising:

a mud motor; and the mud motor protector as claimed in claim 1 fluidly connected to the mud motor.

15. A well system comprising:

a borehole in a subsurface formation;

a string disposed in the borehole;

the mud motor protector as claimed in claim 1 connected to the string; and a mud motor fluidly connected to the mud motor protector.

16. A well system comprising:

a borehole in a subsurface formation;

a string disposed in the borehole;

the mud motor protector as claimed in claim 1 connected to the string; and a mud motor fluidly connected to the mud motor protector.

* * * * *